US009297593B2

(12) United States Patent
Lesueur et al.

(10) Patent No.: US 9,297,593 B2
(45) Date of Patent: Mar. 29, 2016

(54) GROOVELESS HEADER PLATE

(75) Inventors: Jean-Marc Lesueur, Reims (FR); Christian Riondet, Bourgogne (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 525 days.

(21) Appl. No.: 12/867,596

(22) PCT Filed: Feb. 12, 2009

(86) PCT No.: PCT/EP2009/051642

§ 371 (c)(1),
(2), (4) Date: Oct. 6, 2010

(87) PCT Pub. No.: WO2009/101138

PCT Pub. Date: Aug. 20, 2009

(65) Prior Publication Data

US 2011/0017435 A1 Jan. 27, 2011

(30) Foreign Application Priority Data

Feb. 13, 2008 (FR) ..... 08 00760

(51) Int. Cl.
*F28F 9/02* (2006.01)

(52) U.S. Cl.
CPC ..... *F28F 9/0226* (2013.01); *F28F 9/0219* (2013.01); *F28F 9/0224* (2013.01)

(58) Field of Classification Search
CPC ..... F28F 9/0226; F28F 9/0273; F28F 9/0224; F28F 9/02; F28F 9/0219
USPC ..... 165/81, 83, 173
See application file for complete search history.

(56) References Cited

U.S. PATENT DOCUMENTS

| | | | | |
|---|---|---|---|---|
| 6,296,051 | B1 * | 10/2001 | Sahnoun et al. | 165/173 |
| 6,932,152 | B2 * | 8/2005 | Iwasaki et al. | 165/83 |
| 6,988,544 | B2 * | 1/2006 | Ozaki et al. | 165/173 |
| 7,007,745 | B2 * | 3/2006 | Iwasaki et al. | 165/81 |
| 7,156,401 | B2 | 1/2007 | Merklein et al. | |
| 2002/0162648 | A1 * | 11/2002 | Crook | 165/153 |

FOREIGN PATENT DOCUMENTS

| | | | |
|---|---|---|---|
| DE | 4243495 | A1 | 6/1994 |
| DE | 10360472 | A1 | 7/2004 |

(Continued)

OTHER PUBLICATIONS

English language abstract for DE 4243495 extracted from espacenet.com database dated Dec. 21, 2010, 7 pages.
English language abstract for DE 10360472 extracted from espacenet.com database dated Jan. 17, 2011, 14 pages.
French patent FR 2031668 extracted from espacenet.com database Dec. 21, 2010, 12 pages, No English Available.

(Continued)

*Primary Examiner* — Marc Norman
*Assistant Examiner* — Jon T Schermerhorn
(74) *Attorney, Agent, or Firm* — Howard & Howard Attorneys PLLC

(57) ABSTRACT

The invention relates to a header plate (1) of a heat exchanger, comprising a plurality of openings or sockets (2) intended for the fixing of a plurality of tubes or the like through which at least one fluid flows, the header plate extending along a planar surface (XX), characterized in that the distance between two adjacent openings or sockets (2), or "tube spacing" (p), is less than 9.5 millimeters (mm). The invention also relates to a header tank with such a header plate (1) and to a brazed or "mechanical" heat exchanger including such a header tank.

11 Claims, 2 Drawing Sheets

(56) References Cited

FOREIGN PATENT DOCUMENTS

Figure 1:
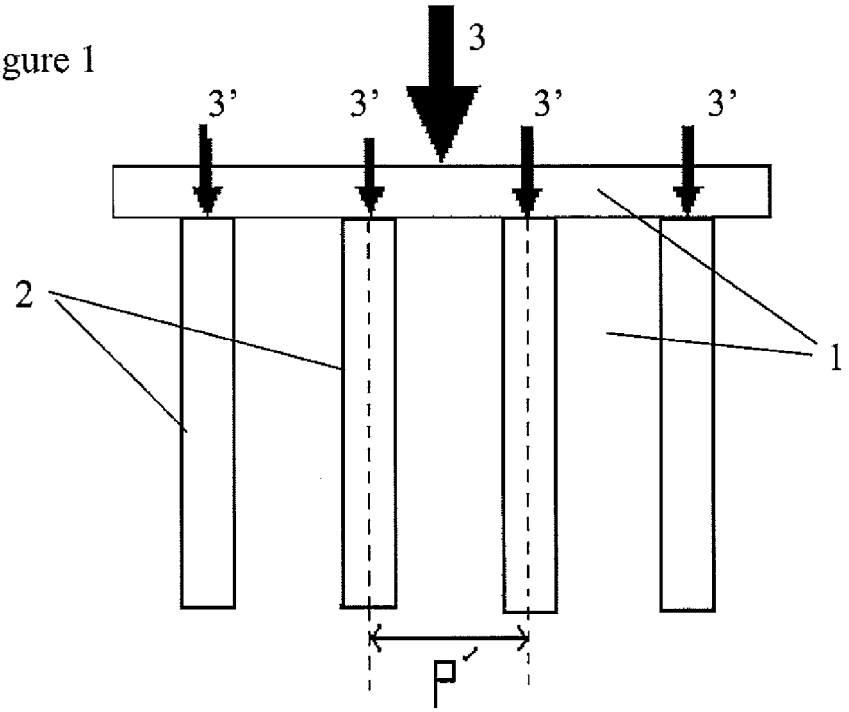

| | | | |
|---|---|---|---|
| EP | 1462754 | A2 | 9/2004 |
| FR | 2031668 | A5 | 11/1970 |
| FR | 2093349 | A5 | 1/1972 |
| FR | 2867553 | A1 | 9/2005 |
| GB | 1353928 | A | 5/1974 |
| WO | WO 2005066568 | A1 | 7/2005 |
| WO | WO 2006004071 | A1 | 1/2006 |
| WO | WO 2009101101 | A1 | 8/2009 |

OTHER PUBLICATIONS

English language equivalent for FR 2093349 extracted from espacenet.com database Dec. 21, 2010, 12 pages.
English language abstract for FR 2867553 extracted from espacenet.com database Dec. 21, 2010, 14 pages.
PCT International Search Report for PCT/EP2009/051557, dated Apr. 24, 2009, 4 pages.
PCT International Search Report for PCT/EP2009/051642, dated Apr. 20, 2009, 5 pages.

* cited by examiner

GROOVELESS HEADER PLATE

RELATED APPLICATIONS

This application claims priority to and all the advantages of International Patent Application No. PCT/EP2009/051642, filed on Feb. 12, 2009, which claims priority to French Patent Application No. FR 08/00760, filed on Feb. 13, 2008.

The invention relates to the field of heat exchangers, particularly for motor vehicles.

The invention relates more specifically to a header tank mounted on a heat exchanger, such as a radiator for engine coolant. This type of radiator conventionally uses tubes and inserts positioned between the tubes for the heat exchange core, while the header tank comprises at least two parts, one of them forming the header plate intended to receive and fix the ends of the tubes of the heat exchange core and the other forming the cover intended to be fixed to the header plate in order to close the header plate at least in part.

Header tanks are generally of two types, namely of the "all metal" type or of the type provided with a cover made of plastic. The "all metal" type of header tank has a certain number of advantages over the type of header tank that has a plastic cover and entails the fitting of a sealing means, conventionally an elastic sealing gasket, in order to ensure a perfectly watertight connection between the cover and the header plate.

The header plate has a groove or channel intended for the placement and positioning of the sealing gasket. The cover is then positioned on the sealing gasket and then, conventionally, the header plate is crimped, for example using teeth situated on the periphery of the header plate.

Nonetheless, particularly with a view to reducing the dimensions of the header tank, some header plates have no groove or channel to make it easier to position the sealing gasket and hold it in position. This grooveless or channel-free header plate is disclosed and described in document EP 1702191 filed by the applicant company.

In this last type of header plate, one major problem lies in the crimping or similar operation used to fix the cover to the header plate. The problem is that, during this operation, the header plate experiences very high localized pressures and the absence of any groove (at least one step being present, giving substantial axial strength) considerably weakens the header plate (around its edge and at its sockets intended for the tubes) which means that this header plate is liable to break during the crimping operation or be damaged enough by this crimping operation that the sealing of the header tank is deficient, or that its life is thereby considerably shortened.

Document FR 2867553 addresses this problem. The solution it proposes is a peripheral deformation of the header plate to make the header plate stronger at the time of crimping. This solution is particularly difficult to implement and has the major disadvantage of adding considerable bulk.

A fairly similar solution is also known and this likewise consists in creating deformations between the sockets of the grooveless or channel-free header plate, still with a view to allowing it to survive the crimping operation. Once again, this solution is particularly difficult to implement.

Furthermore, in the grooveless or channel-free header plates of the prior art, another problem encountered is that of holding in position the gasket used to provide sealing against the cover fixed to the plate. In tanks that do have a groove or channel, said groove or channel is used specifically for positioning the gasket. When, as in the planar plates, there is no longer a groove or a channel, the gasket is particularly difficult to position. What is more, poor positioning of the gasket carries the risk of leading to leaks between the plate and the cover, particularly if the gasket is nipped or inadequately compressed. This difficulty has hitherto greatly restricted the use of flat-plate exchangers.

It is an object of the present invention to address the disadvantages of grooveless or channel-free header plates of the prior art by proposing a solution to achieve optimal attachment between the cover and the header plate, without damaging the header plate, its sockets, or the ends of the tubes, and at the same time ensuring correct gasket positioning.

Thus, the invention consists in a header plate of a heat exchanger, comprising a plurality of openings or sockets intended for the fixing of a plurality of tubes or the like through which at least one fluid flows, said header plate extending along a planar surface, characterized in that the distance between two adjacent openings or sockets, or "tube spacing" p, is less than 9.5 millimeters (mm).

What the expression "planar surface" means when applied to the header plate is that this header plate extends in a single planar surface, with the exception of the sockets which protrude in the conventional way, particularly at its periphery, such that the header plate has no groove, no structural reinforcement (projecting upward or downward with respect to the mean plane of the header plate), no channel or the like, conventionally used to house the sealing means (conventionally an elastic gasket) and which also has the function of reinforcing the header plate at the time of the crimping of the teeth or the like thereof in order to fix the cover onto the header plate.

Other advantageous aspects of the invention are listed below:

- the distance between two adjacent openings or sockets, or "tube spacing" p, is comprised between 5 and 8 mm;
- the height of the sockets is comprised between 1 and 5 mm, particularly between 1 and 2.5 mm.

Furthermore, said plate is equipped with crimping teeth, provided at its periphery. Said teeth are, for example, spaced apart and give the periphery of the plate a crenellated appearance. They thus have a dimension l, known as the width, considered in a direction directed parallel to a long side of the plate. A crimping tooth density can be defined as being the ratio between, on the one hand, the combined width of the teeth and, on the other hand, the length L of said long side, considered in the straight portion thereof, that is to say, excluding the end regions of the plate if this radiused.

In order further to improve the strength of the plate during crimping, the ratio of the crimping tooth density to the tube spacing can be chosen to fall between 0.04 and 0.17, for example between 0.06 and 0.09.

The invention also relates to a header tank including a header plate according to that which has been defined hereinabove, and a cover. For preference, the material thickness of the header plate, or of the parts that make up the header plate, is comprised between 0.8 mm and 2 mm, preferably between 0.8 mm and 1.5 mm.

Said tank is equipped with a sealing gasket, positioned at the periphery of the plate, between said plate and the cover. In order further to improve the positioning of the gasket, the ratio between p-h, p being the "tube spacing" and h the "tube height" or the dimension of the short axis of the orifices through which the tubes pass, to the diameter d of the gasket being comprised between 1 and 3. In other words (p-h)/d is comprised between 1 and 3, for example between 1.5 and 2.5.

What is meant by the diameter d of the gasket is, if the gasket is not round, the diameter of a round gasket that has the same cross sectional area.

The invention finds applications both in brazed heat exchangers and in so-called "mechanical" heat exchangers in which the components of the header tank, namely, conventionally, the header plate and the cover, are also fixed together permanently by mechanical means, for example crimping, clamping or the like. It will be noted that a so-called "brazed" heat exchanger does not employ any mechanical fastening steps to create it, with the exception of the step of crimping, or prefixing, the cover onto the header plate. The components of the header tank and of the heat exchanger incidentally being brazed together.

Thus, the invention relates to a heat exchanger of the brazed type, particularly for motor vehicles, comprising a heat exchange core consisting of a plurality of tubes or the like, the ends of which are respectively fixed to two header tanks, characterized in that the two header tanks are as specified hereinabove.

The invention also relates to a heat exchanger, particularly for motor vehicles, comprising a heat exchange core consisting of a plurality of tubes or the like, the ends of which are respectively fixed to two header tanks, the components constituting said header tank being fixed together mechanically, characterized in that the two header tanks are as specified hereinabove.

For preference, the exchanger will have at least one of the following features:

- the height h of the tubes is comprised between 1 and 8 mm, particularly between 1 and 5 mm, and preferably between 1 and 2 mm;
- the lateral edges of the ends of the tubes have a circular or rectangular cross section;
- the material thickness of the tubes is comprised between 0.15 and 0.5 mm, particularly between 0.15 and 0.35 mm, and preferably between 0.15 and 0.27 mm.

Figure 2:
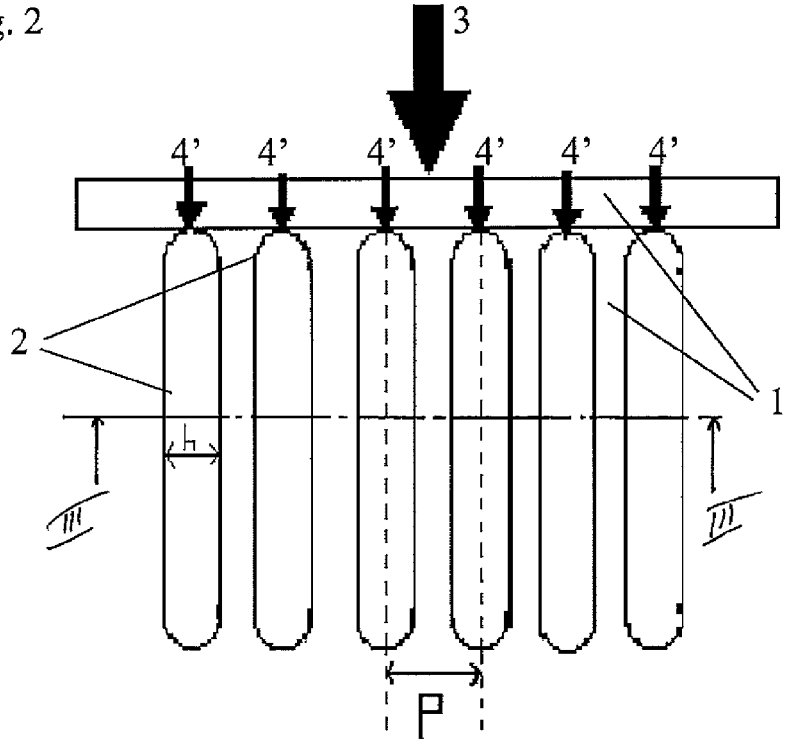
Figure 3:
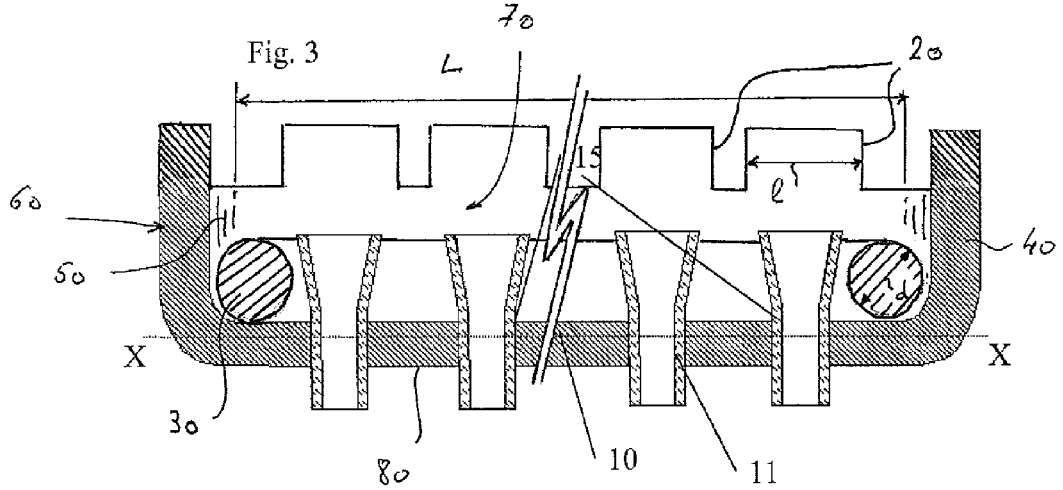
Figure 4:
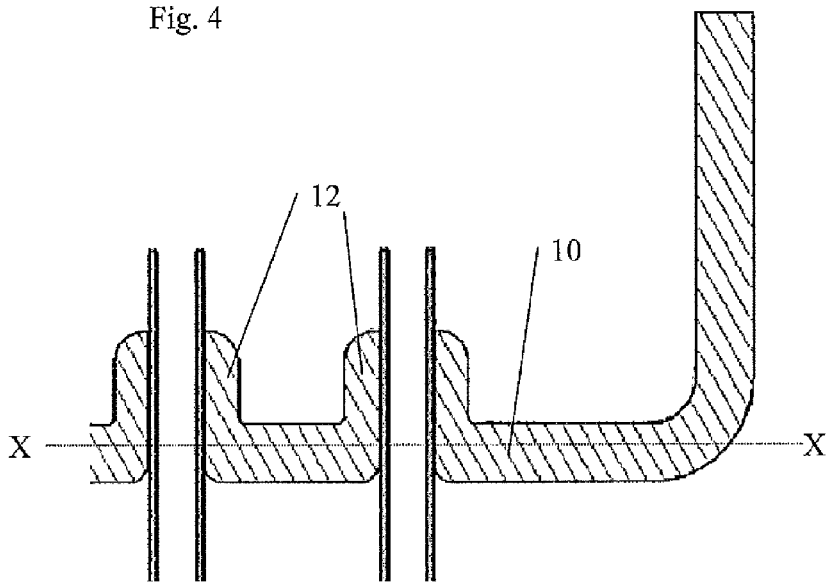

In the description which follows, which is given solely by way of example, reference is made to the attached drawings, in which:

FIG. 1 is a schematic cross section illustrating a portion of a header plate of the prior art with its openings or sockets intended to accept the ends of tubes and the forces that are applied to the header plate and to the sockets thereof or to the ends of the tubes;

FIG. 2 is a schematic cross section illustrating a portion of a header plate according to the invention with its openings or sockets intended to accept the ends of tubes and the forces applied to the header plate and to the sockets or to the ends of the tubes, FIG. 3 is a view in part section of a header plate according to the invention, the section being a section on III-III of FIG. 2, that is to say along the longitudinal axis of said plate, FIG. 4 is a simplified part section view of part of another embodiment of the header plate according to the invention, the section once again being a section on III-III of FIG. 2.

FIG. 1 shows a part section of a header plate 1 illustrating the openings or sockets 2 for a header tank (sometimes also known as "collector") of the prior art. This figure also illustrates the forces 3, 3' acting on the header plate 1, and thus on each of the sockets or openings 2 present in said plate 1 or on the ends of the tubes.

The header tank of the invention is a header tank provided with a part or plate 1 the function of which is to collect together the ends of the tubes; this header plate 1 extending in a single plane and having no indentation, channel, step or any other deformation the purpose of which is to provide structural reinforcement because the purpose of the invention is to disclose a different and advantageous solution for reinforcing the header plate 1 and the sockets 2 thereof and thereby the ends of the tubes, particularly during and subsequent to crimping thereof.

Aside from the aspects specific to the present invention, the header tank is produced in the conventional way and has no technical peculiarity that distinguishes it for example from that which is described in EP 1702191 in the name of the applicant company. Likewise, the heat exchanger, of the brazed type or of the "mechanical" type does not, aside from its specific features associated with the present invention, have any other features that differentiate it from the prior art.

The header tank of the prior art comprises sockets generally of rectangular, circular or similar shape. The distance between two sockets 2, corresponding to the tube spacing p', is at least equal to 12 mm. Thus, in this embodiment, during crimping, a force 3 is applied to the periphery of the header plate 1 and this force is almost essentially spread over the lateral ends 3' of the sockets 2 or over the ends of the tubes, whereas this part of the sockets 2 or of the ends of the tubes is particularly fragile. Thus, the force 3, 3' applied to each of the lateral end parts is significant and damages the header plate 1 or said lateral ends of the sockets 2, or the ends of the tubes.

Surprisingly, the applicant company has discovered that one solution to this technical problem is to provide a tube spacing p that lies within a certain range. This range for the tube spacing p or distance between two adjacent sockets 2 (considered in the middle of each of the openings/sockets) is thus defined in the broadest terms as being less than 9.5 mm. Furthermore, particularly advantageous ranges both regarding the tube spacing p and in relation to the height h of the tubes, have also been discovered by the applicant company, on the basis of this broad range.

The idea of an opening means that there is just an opening 15 in the header plate 10 for accepting a tube 11, as opposed to the idea of sockets 12 which correspond to that part of the header plate 10 that stands up above/hangs down below the mean plane (or surface) XX of the header plate. For a clear understanding, a header plate 10 with openings 15 is depicted in FIG. 3, and a header plate 10 with sockets 12 is depicted in FIG. 4; these two header plates 10 each comprise holes of the same dimensions corresponding to the width of the tubes 11.

The cover, not depicted in the attached figures, is fixed to the header plate in a way that is perfectly known to and mastered by those skilled in the art, for example using teeth 20, illustrated in FIG. 3, provided for this purpose on the header plate for crimping to the edges of the cover.

Said crimping teeth 20 are provided at the periphery plate, at a lateral edge 40 thereof, said lateral edge surrounding the planar part 80, equipped with orifices for the passage of the tubes, of the plate. Said teeth are, for example, spaced apart and give the upper part of the lateral edge 40 of the plate a crenellated appearance.

Said teeth 20 notably have a dimension, known as the width l, considered in a direction directed parallel to a long side of the plate. Further, said plate has a crimping tooth density, defined as being the ratio between, on the one hand, the combined width of the teeth and, on the other hand, the length L of said long side considered in the straight portion thereof, that is to say, in this instance, without taking into consideration the radii 50 that connect the lateral 60 and longitudinal 70 parts of the lateral edge 40. The density of crimping teeth to the tube spacing is comprised, for example, between 0.04 and 0.17.

A sealing gasket 30 of a header tank of an exchanger according to the invention has been depicted in FIG. 3, prior to compression. It is situated around the periphery of the planar part 80 of the header plate, between the ends of the tubes that open into the tank and the lateral edge 40 of the plate.

The ratio of p-h to the diameter d of the gasket may be comprised between 1 and 3.

The invention claimed is:

1. A header plate (1) of a heat exchanger, said header plate (1) equipped with crimping teeth (20) provided at its periphery and comprising a plurality of openings intended for the fixing of a plurality of tubes through which at least one fluid flows, the lateral edges of ends of said tubes have a circular cross section, said header plate (1) being grooveless and extending along a planar surface (XX), a gasket having a diameter prior to compression and disposed around a periphery of the planar surface of said header plate (1) between open ends of the tubes and a lateral edge of said header plate (1) and spaced laterally from said tubes, wherein the distance between two adjacent openings, or tube spacing (p), is less than 9.5 millimeters (mm), and wherein a height of said tubes is between 1 and 5 mm, and said header plate (1) being without sockets around said openings, and wherein said teeth (20) have a width 1 in a direction directed parallel to a long side of said header plate (1), said header plate (1) having a crimping tooth density defined as the ratio between the combined width of said teeth (20) and the length L of said long side in the straight portion thereof, the crimping tooth density to the tube spacing being between 0.04 and 0.17, in which the ratio between p-h, p being the tube spacing and h being the dimension of the short axis of the orifices through which the tubes pass, to the diameter d of said gasket (30) being between 1 and 3.

2. The header plate (1) as claimed in claim 1, characterized in that the distance between two adjacent openings, or (p), is between 5 and 8 mm.

3. A header tank of a heat exchanger, comprising a header plate (1) as claimed in claim 1, and at least one cover intended to close said header tank at least in part when fixed to said header plate (1).

4. The header tank as claimed in claim 3, characterized in that the material thickness of said header tank, or of the parts that make up said header tank, is between 0.8 mm and 2 mm.

5. A heat exchanger of the brazed type, comprising a heat exchange core comprising a plurality of tubes, the ends of which are respectively fixed to two header tanks, characterized in that said two header tanks are as claimed in claim 3.

6. A heat exchanger, comprising a heat exchange core comprising a plurality of tubes, the ends of which are respectively fixed to two header tanks, the components constituting said header tank being fixed together mechanically, characterized in that said two header tanks are as claimed in claim 3.

7. The heat exchanger as claimed in claim 5, characterized in that the material thickness of said tubes is between 0.15 and 0.5 mm.

8. The header plate (1) as claimed in claim 1, characterized in that the height of said tubes is between 1 and 2.0 mm.

9. The header tank as claimed in claim 3, characterized in that the material thickness of said header tank, or of the parts that make up said header tank, is between 0.8 mm and 2 mm.

10. The heat exchanger as claimed in claim 5, characterized in that the material thickness of said tubes is between 0.15 and 0.35 mm.

11. The heat exchanger as claimed in claim 6, characterized in that the material thickness of said tubes is between 0.15 and 0.5 mm.

* * * * *